United States Patent [19]

Johnson

[11] Patent Number: 4,572,052

[45] Date of Patent: Feb. 25, 1986

[54] DECLIPPER/FEEDER

[75] Inventor: Joseph L. Johnson, Canadian, Okla.

[73] Assignee: The United States of America as represented by the Secretary of the Army, Washington, D.C.

[21] Appl. No.: 491,840

[22] Filed: May 5, 1983

[51] Int. Cl.[4] ..... F42B 39/10

[52] U.S. Cl. ..... 86/48

[58] Field of Search ..... 89/33.01, 33.1, 33.4, 89/33.05, 34, 33.5; 86/1 R, 1 A, 24, 45–48

[56] References Cited

U.S. PATENT DOCUMENTS

| | | | |
|---|---|---|---|
| 924,732 | 6/1909 | Carey | 89/33.1 |
| 1,355,684 | 10/1920 | Northover | 86/47 |
| 2,192,677 | 3/1940 | Hoagland et al. | 89/33.1 X |
| 2,557,441 | 6/1951 | Kornblum et al. | 89/33.5 |
| 2,561,255 | 7/1951 | White et al. | 89/33.5 |
| 2,659,263 | 11/1953 | Costello | 86/47 |
| 2,830,498 | 4/1958 | Maillard | 89/33.17 |
| 3,683,743 | 8/1972 | Stoner | 89/13.5 X |

*Primary Examiner*—Stephen C. Bentley

*Attorney, Agent, or Firm*—Anthony T. Lane; Robert P. Gibson; Edward F. Costigan

[57] ABSTRACT

A declipper/feeder that removes the clip holding several cartridges and feeds the cartridges into a linking machine to provide belted ammunition. A reciprocating push plate pushes the cartridges from the clip into a feed tray, permitting the clip to fall into a disposal container. From the feed tray the cartridges are gravity fed to a linking machine for the next operation in providing belted ammunition. The push plate reciprocating mechanism has a "breakover" arm that will pivot over upon itself to prevent damaging a jammed cartridge or stalling the motor and allowing automatic reset on the next rotation of the motor drive.

2 Claims, 4 Drawing Figures

SENSOR 80
10
12
14
16
18
20
22
24
26
28
30
32
34
36
38
40
42
44
46
48
50
54
56
58
60

76
78
32
68
72
26
30
24
52
66
28
38
68
50
60
58
56
48
54
44
42
40
22
SENSOR
80

MICROSWITCH
74
70
76
78

32
68
72
26
24
36
38
50
62
64
46
58
48
60
44
42
40
SENSOR
80

DECLIPPER/FEEDER

GOVERNMENT INTEREST

The invention described herein may be manufactured and/or used by or for the Government for governmental purposes without the payment of any royalty thereon.

BACKGROUND OF THE INVENTION

Cartridges are assembled in clips which hold several together for handling, shipping, etc. One such arrangement is shown in FIG. 1. The problem is presented as to how to remove the clip and combine the cartridges with many more to form belted ammunition, such as is used in machine guns, for example. A declipper previously used to remove the clips from the cartridges consisted of a rubber roller that "wiped" the clips from the captive cartridges and allowed them to fall into a container. Because of its design the rubber rollers frequently wore out, causing the cartridges to jam and occasionally to explode. The declipper had no feed capability and the container of cartridges had to be carried to the linking machine where they were manually sorted and placed in the linker feed trays. A need therefore exists for a machine that will automatically declip the ammunition and feed it into the linking machine for belted ammunition in a one-step operation.

SUMMARY OF PRESENT INVENTION

In accordance with the present invention a declipper/feeder has been developed that removes the captive cartridges from their clip, permitting the clip to be discarded, while feeding the liberated cartridges into a linking machine for belted ammunition.

In operation the rotating motion of a motor is converted to a reciprocating motion to drive a push block back and forth. The push block pushes cartridges out of the bottom-most clip. A drive arm is so designed to pivot over upon itself (break over) to prevent damaging a wedged cartridge or stalling of the motor, and allowing an automatic reset on the next rotation of the motor drive. A clip chute is manually loaded and allows clips to settle onto support rails consecutively as cartridges are ejected from each bottom clip and are forced out of a slit onto the feed tray. A "tray full" sensor, activated when the feed tray is filled to capacity, turns off the motor until the tray has been partially emptied, and then restarts the motor automatically. When the "tray full" sensor signals the motor to stop, the motor continues to turn until the push block is fully retracted from the chute, allowing clips in the chute to fall squarely into place ready for the next cycle. At this point a position sensor completes the turn-off of the motor. When the level of cartridges drops in the feed tray the sensor switch reverses, overriding the position sensor, causing the motor to start. The feed tray is slightly curved to match the natural roll of the individual cartridges and is designed to fit with the input gate of the linking machine.

DETAILED DESCRIPTION OF PREFERRED EMBODIMENT

Figures 1, 2:
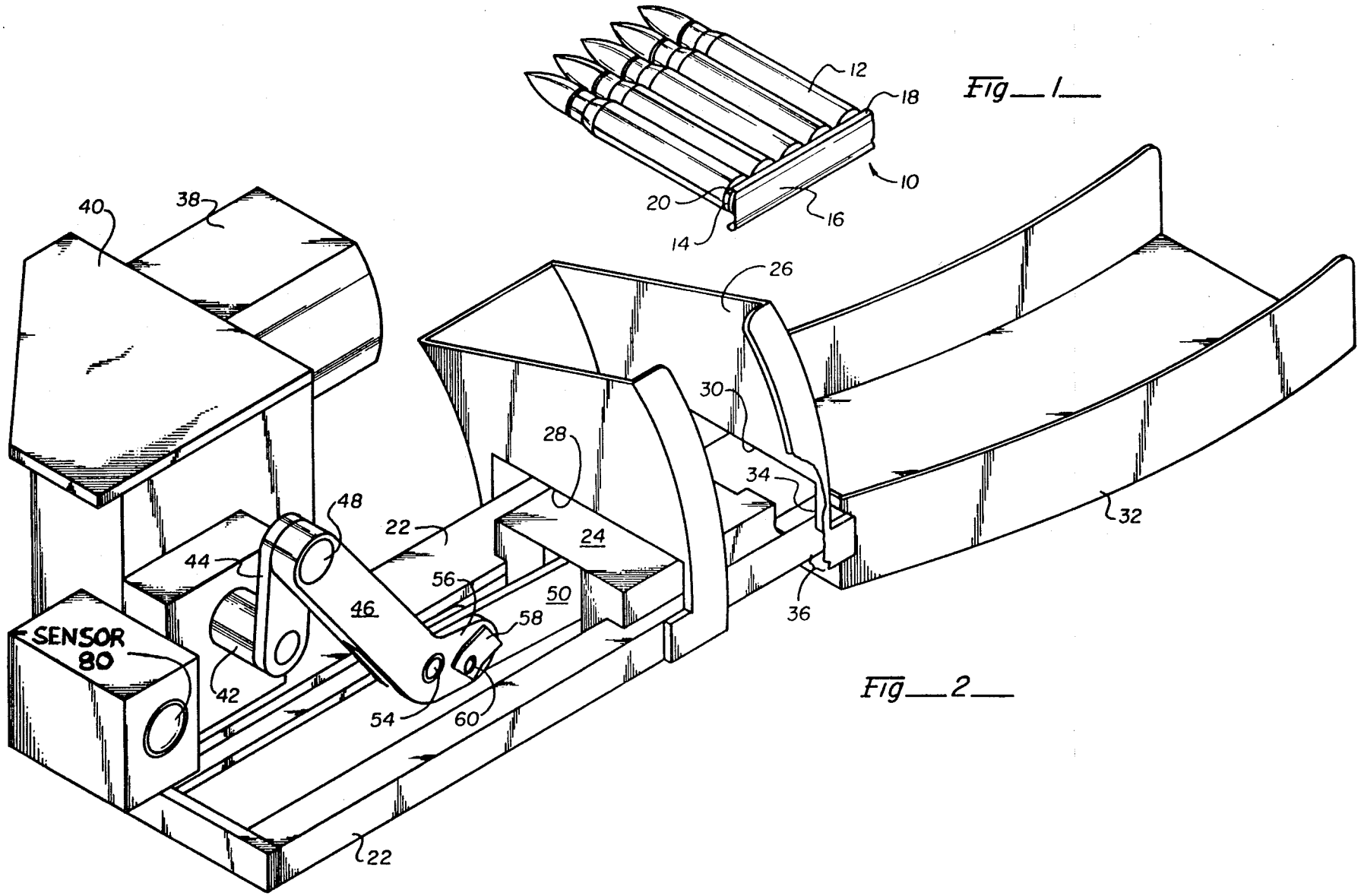
FIG. 1 is a perspective view of a typical cartridge clip with cartridges.
FIG. 2 is a perspective view of the declipper/feeder machine but without the tray full sensor.

Reference is now made to FIG. 1 wherein is shown a typical clip 10 having five cartridges 12 mounted therein. The cartridge casings have annular grooves 14 in their periphery near the end thereof for assisting in their extraction from the weapon from which they are fired. Clip 10 has a flat base portion 16 with upturned sides 18 which terminate in inturned flanges or lips 20. The cartridges 12 are attached to the clip 10 by placing their annular grooves 14 between the opposed lips 20 on the clip 10. This is the usual configuration for handling and shipping of the cartridges. In loading rifle magazines (not shown) the clip 10 bears against the top of the magazine and the cartridges 12 are slid out the end of the clip and into the magazine. When the cartridges are used as belt ammunition, as previously mentioned, in the past a rubber roller frictionally engaged the bottom of base portion 16 and removed it from the cartridges. These cartridges then fell into a container for subsequent feeding into a linking machine where they were assembled with the aid of links into ammunition belts to be used in machine guns, for example. It is in this second use, i.e., as belt ammunition that the present invention finds application.

Reference is now made to FIG. 2 wherein there is shown the declipper/feeder machine comprising the present invention. It consists of a pair of spaced support rails 22 between which is a sliding push block 24 and over which is a cartridge clip chute 26. The clip chute is structured to receive a plurality of stacked cartridge clips of the type shown in FIG. 1. They are manually stacked from the top of the chute. The chute 26 has a slot 28 to permit passage of the push block 24 into the chute to push the lower set of cartridges from its clip and out slot 30 into feed tray 32. The front end of the clip chute is open to facilitate manual stacking of loaded clips into the chute. Slot 30 terminates with a vertical edge 34 against which the end of the clip abutts as the cartridges are pushed through slot 30. The empty clip falls through gap 36 into a container, not shown. The feed tray 32 tilts downwardly to gravity feed the liberated cartridges to the next station, a linking machine, not shown.

The sliding push block 24 reciprocates through its connection with variable speed motor 38, transmission gear box 40, drive shaft 42, and crank 44. This connection includes a drive arm 46 pivotally connected at 48 to crank 44, and a push arm 50 pivotally connected, at 52 in FIG. 3, to the sliding push block 24. Drive arm 46 and push arm 50 are pivotally connected at 54 with drive arm 46 having an extension 56 abutting the side of push arm 50. A flat spring 58 is attached to extension 56 by means of a screw 60. Behind the screw is a truncated conical aperture 62 in extension 56, identified as 62 in FIG. 4. A steel ball 64 is positioned in the aperture and is seated by the spring 58. A portion of ball 64 projects through the aperture and bears against a detent or retaining hole in the side of push arm 50. The friction of the ball 64 against the push arm 50 tends to keep the drive arm 46 and push arm 50 aligned as shown. In opposition to this is a coiled spring 66 between extension 56 and push arm 50 at points below the axis between pivot points 52 and 54. This tends to cause the two arms 46 and 50 to buckle and their interconnecting pivot 54 to move upwardly as shown by arrow 68 in FIG. 3. However, there is normally equilibrium between the two forces as crank 44 revolves around the drive shaft 42 and push block 24 moves into the clip chute 26 to eject the bottom cartridges from their associated clip and into the feed tray 32. However, if the cartridges jamb or become wedged and cannot exit the clip chute 26 through slot 30, the drive arm 46 and push arm 50 will buckle upwardly, as just described, to prevent damaging the cartridge or stalling the motor. The arms automatically reset to the positions shown on the next rotation of the motor drive.

Figure 3:
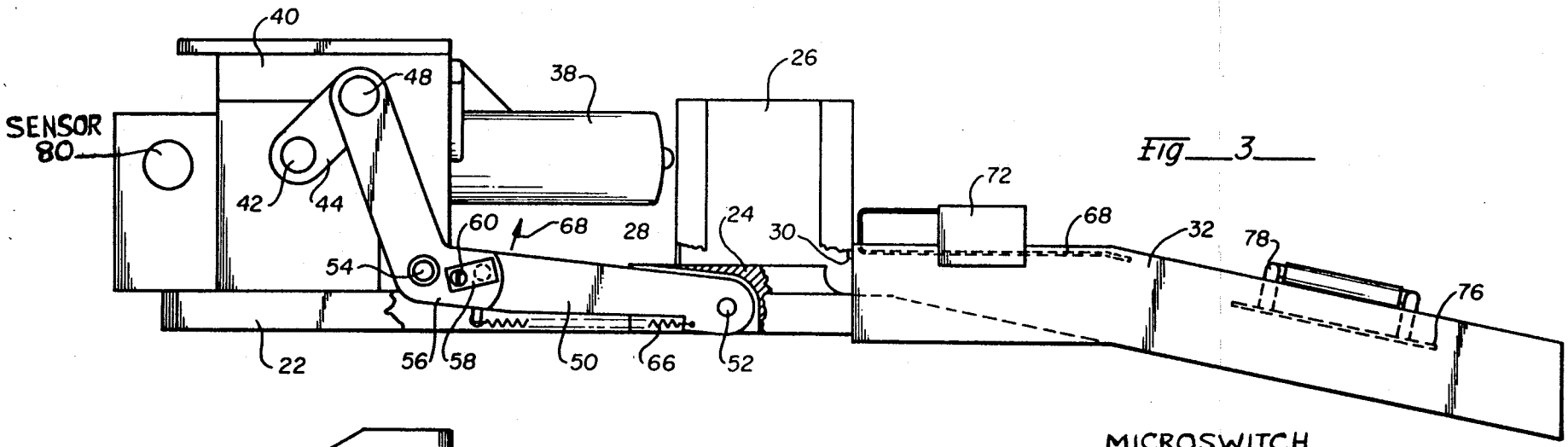
FIG. 3 is a side view with parts broken away to more clearly show the operation of the reciprocating mechanism.
Figure 4:
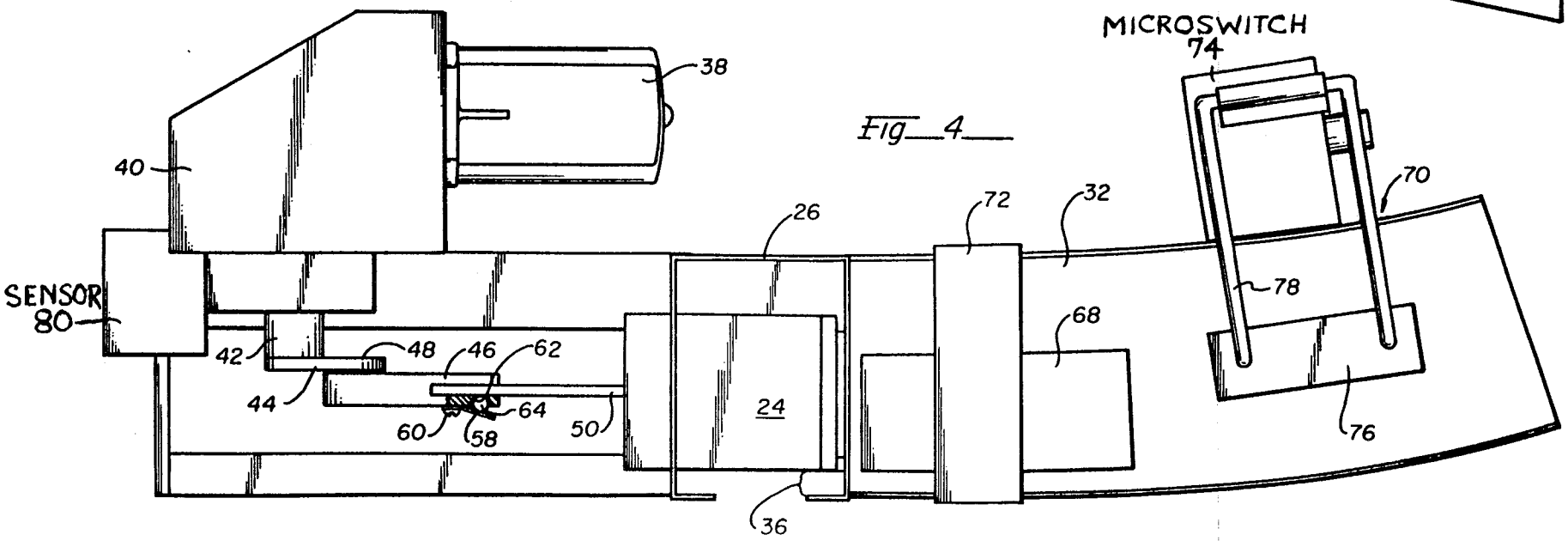
FIG. 4 is a plan view with a part broken away to more clearly show the "breakover" arm.

Shown in the side view in FIG. 3 and the plan view in FIG. 4 is the feedtray overflow guard 68 and tray full sensor 70. The overflow guard 68 is mounted to an overhead support 72 and becomes an overhead roof barrier to cause the cartridges to gravity feed down the sloping feed tray 32 toward the linking machine, not shown. The tray full sensor 70 is a microswitch 74 activated by upward movement of the cartridge contact plate 76 on switch arms 78. When the "tray full" sensor 70 signals the motor 38 to stop, the motor continues to turn until the push block 24 is fully retracted from the chute 26, allowing clips in the chute to fall squarely into place ready for the next cycle. At this point the crank 44 is over the magnetic position sensor 80 which completes the turnoff of the motor. When the level of cartridges drops in the feed tray 32, the sensor switch 70 reverses, overriding the position sensor 80, and causing the motor to restart and the push block 24 to reciprocate again.

A control panel, not shown is used in operating the machine. This panel has "start", "stop", "reverse", "jog", and "emergency stop" buttons, and a speed control dial. In operation the "start" button causes the motor to run continuously, causing the push block 24 to reciprocate. When the "stop" button is pushed, the motor continues to run until the push block is recycled, in the same manner as when the tray full sensor is activated. However, the "start" button must be pushed to restart the motor. If the "emergency stop" button is pushed, the motor stops immediately, regardless of the push block position. The "jog" button may be used to start motor rotation but the motor stops when the button is released. The "jog" button may be used for releasing a jam or for other momentary purposes. Pushing the "reverse" button causes the motor to reverse, either during normal operations or for jogging. The electrical circuits from the motor and various switches to the control panel are conventional and straightforward and therefore are not now described. With the various control panel buttons, it is believed that a skilled electrician can provide the wiring and appropriate connections without requiring invention in this area.

The invention in its broader aspects is not limited to the specific combinations, improvements and instrumentalities described but departures may be made therefrom within the scope of the accompanying claims without departing from the principles of the invention and without sacrificing its chief advantages.

I claim:

1. A combination declipper and feeder for use in removing an individual clip from a plurality of cartridges held together in alignment by such clip and feeding said declipped cartridges to a tray for further assembly into a belt comprising:

a vertical chute receiving a plurality of gravity feed clipped cartridges, said chute having a bottom provided with an aligned first and second slot, a push block reciprocating across said chute from said first to said second slot, said second slot having a vertical edge against which said clip abuts declipping said clipped cartridges as said reciprocating block pushes said cartridges through said second slot said chute having a gap adjacent said edge through which said declipped clip falls by gravity, a crank having a rotary shaft driven by a motor, said push block connected to said crank by pivotally connected first and second arms, said first arm connected to said crank and said second arm pivotally connected to said block, a sloping slightly curved feed tray adjacent said second slot to receive said declipped cartridges, said curve facilitating the natural roll of said declipped cartridges, a guard overhead said feed tray to prevent spillage, and a sensor having a microswitch provided with an activating contact plate also overhead said feed tray, said sensor deactivating the reciprocation of said push block when said tray is full of cartridges.

2. A combination declipper and feeder for use in removing an individual clip from a plurality of cartridges held together in alignment by such clip and feeding said declipped cartridges to a tray for further assembly into a belt comprising:

a vertical chute receiving a plurality of gravity feed clipped cartridges, said chute having a bottom provided with an aligned first and second slot, a push block reciprocating across said chute from said first to said second slot, said second slot having a vertical edge against which said clip abuts declipping said clipped cartridges as said reciprocating block pushes said cartridges through said second slot said chute having a gap adjacent said edge through which said declipped clip falls by gravity, a crank having a rotary shaft driven by a motor, said push block connected to said crank by pivotally connected first and second arms, said first arm connected to said crank and said second arm pivotally connected to said block, an extension having an aperture on said first arm pivotally engaging said second arm, a ball seated in said aperture functionally engaging said second arm, resilient means on said first arm urging said ball against said second arm a sloping slightly curved feed tray adjacent said second slot to receive said declipped cartridges, said curve facilitating the natural roll of said declipped cartridges, a guard overhead said feed tray to prevent spillage, and a sensor having a microswitch provided with an activating contact plate also overhead said feed tray, and said sensor deactivating the reciprocation of said push block when said tray is full of cartridges.

* * * * *